US005570566A

United States Patent [19]

Newcomb

[11] Patent Number: 5,570,566

[45] Date of Patent: Nov. 5, 1996

[54] METHOD AND APPARATUS FOR LOADING PIPETTE TIP HOLDERS

[76] Inventor: William W. Newcomb, 706 Gillespie Ave., Charlottesville, Va. 22902

[21] Appl. No.: 398,085

[22] Filed: Mar. 3, 1995

[51] Int. Cl.[6] ..... B65B 1/22

[52] U.S. Cl. ..... 53/437; 53/448; 53/473

[58] Field of Search ..... 53/437, 446, 448, 53/473, 392, 525, 543, 142, 143, 144, 900

[56] References Cited

U.S. PATENT DOCUMENTS

| | | | |
|---|---|---|---|
| 3,545,164 | 12/1970 | Middleton | 53/473 |
| 3,819,042 | 6/1974 | Smernoff | 206/443 |
| 4,130,978 | 12/1978 | Cohen | 53/473 |
| 4,510,119 | 4/1985 | Hevey | 53/392 |
| 4,729,208 | 3/1988 | Galy et al. | 53/510 |
| 5,148,653 | 9/1992 | Scharch | 53/448 |
| 5,335,481 | 8/1994 | Ward | 53/446 |

*Primary Examiner*—John Sipos
*Assistant Examiner*—Ed Tolan
*Attorney, Agent, or Firm*—Robert A. Ostmann

[57] ABSTRACT

A technique for loading disposable plastic pipette tips in an array of apertures of a tip holder comprises agitating a large volume of tips in a confined space above at least one field of openings having a pattern corresponding to the array to cause tips to lodge in the openings, clearing excess tips from the field, and then transferring lodged tips as a group from the field to the array.

20 Claims, 3 Drawing Sheets

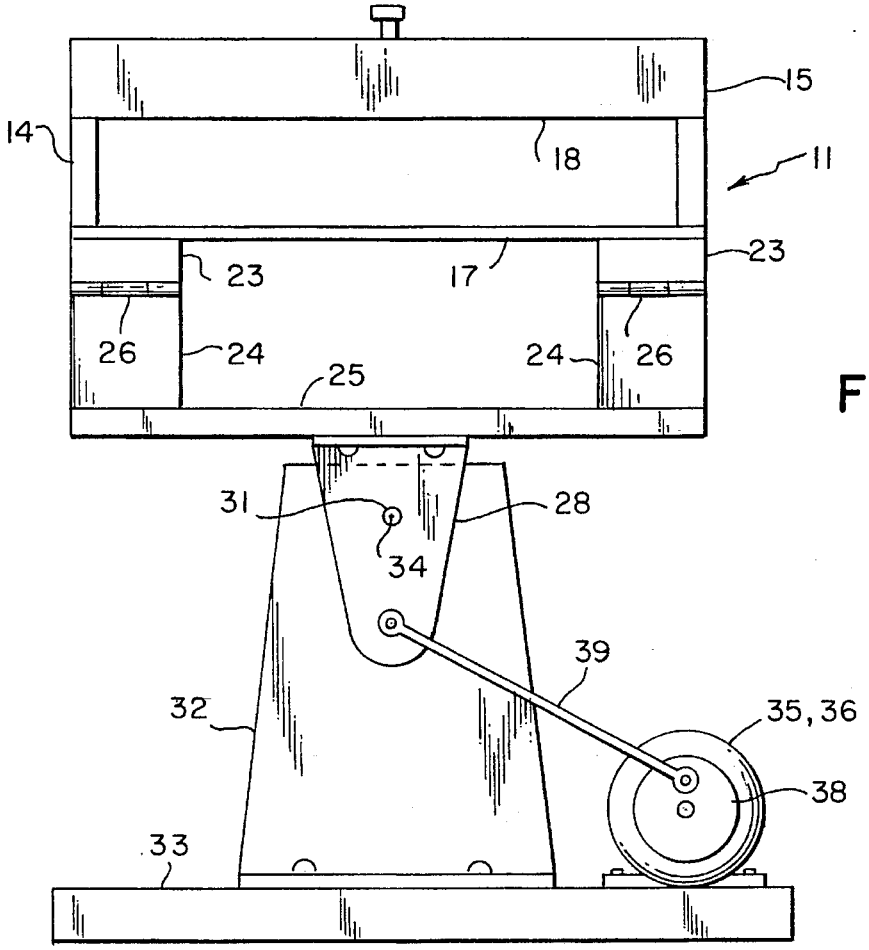
FIG. 2
FIG. 5
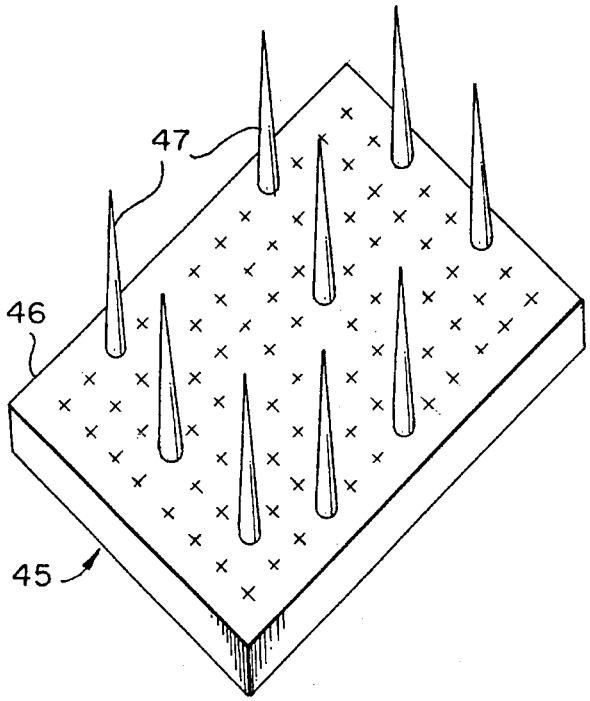

METHOD AND APPARATUS FOR LOADING PIPETTE TIP HOLDERS

BACKGROUND OF THE INVENTION

This invention concerns methods and apparatus for loading pipette tips in the arrays of apertures provided by tip holders.

Disposable, plastic pipette tips are common commodities used by clinical and biomedical research laboratories worldwide in quantities reaching into the billions annually. They usually are supplied in one of three ways, namely, loaded in the array of apertures of a so called box, which serves the user as a rack or holder, or loaded into an array of apertures in a plate which is mated with a holder possessed by the user, or loose in a plastic bag from which they are transferred one-by-one to the apertures of a rack or holder. Loosely packaged tips are the least expensive, so this is the source favored by laboratories. However, the downside of this choice is that loading of the user's holders must be done by hand, which is a labor intensive and time-consuming operation, and one which can result in contamination of the tips even when the technician follows the standard practice of wearing protective gloves.

I am aware that some have suggested automating the tip-loading process at the suppliers' facilities, as evidenced by U.S. Pat. No. 5,335,481, issued Aug. 9, 1994. That proposal, however, involves complex, expensive machinery, so it clearly does not satisfy the needs of the laboratories of individual investigators; these have neither the space nor the funds required to utilize such machinery.

SUMMARY OF INVENTION

The object of the invention is to provide an improved technique for loading tip holders. The technique is vastly more efficient than the hand operation, yet it involves simple, relatively inexpensive apparatus which consumes little space and may even take the form of a portable, bench-top unit. This solution to the loading problem, therefore, should be particularly attractive to the ultimate users of the tips.

According to the invention, the new tip-loading method comprises: (1) agitating a large number of tips in a confined space above at least one field of openings having a pattern corresponding to the array of tip-receiving apertures of the intended tip holder to cause tips to lodge in the openings; (2) clearing excess tips from the field; and (3) then transferring lodged tips as a group from the field to the array. Preferably, several fields of openings, each corresponding to the holder array, are charged simultaneously, and the height of the agitation space is correlated with the length of the tips so as to minimize creation of "doubles", i.e., tips nested in others already lodged in field openings.

The agitating step is performed in a container mounted to be shaken or oscillated by a powered periodic motion generator, and desirably these components of the apparatus are combined in a compact, portable unit. Tip transferring may be carried out in several ways, each of which involves use of a straightener device comprising a group of straight fingers which fit into the tips and have a pattern corresponding to the pattern of the field openings in the container. As is made evident in the following detailed description, the improved technique obviates touching of the tips by the technician. As a result, the risk of contamination is minimized.

BRIEF DESCRIPTION OF THE DRAWINGS

Several embodiments of the invention are described herein with reference to the accompanying drawings, in which:

FIG. 2 is a side elevational view of the same apparatus.

FIG. 5 is a perspective view of a tip-straightening and transfer device.

DETAILED DESCRIPTION OF ILLUSTRATED EMBODIMENT

Figure 1:
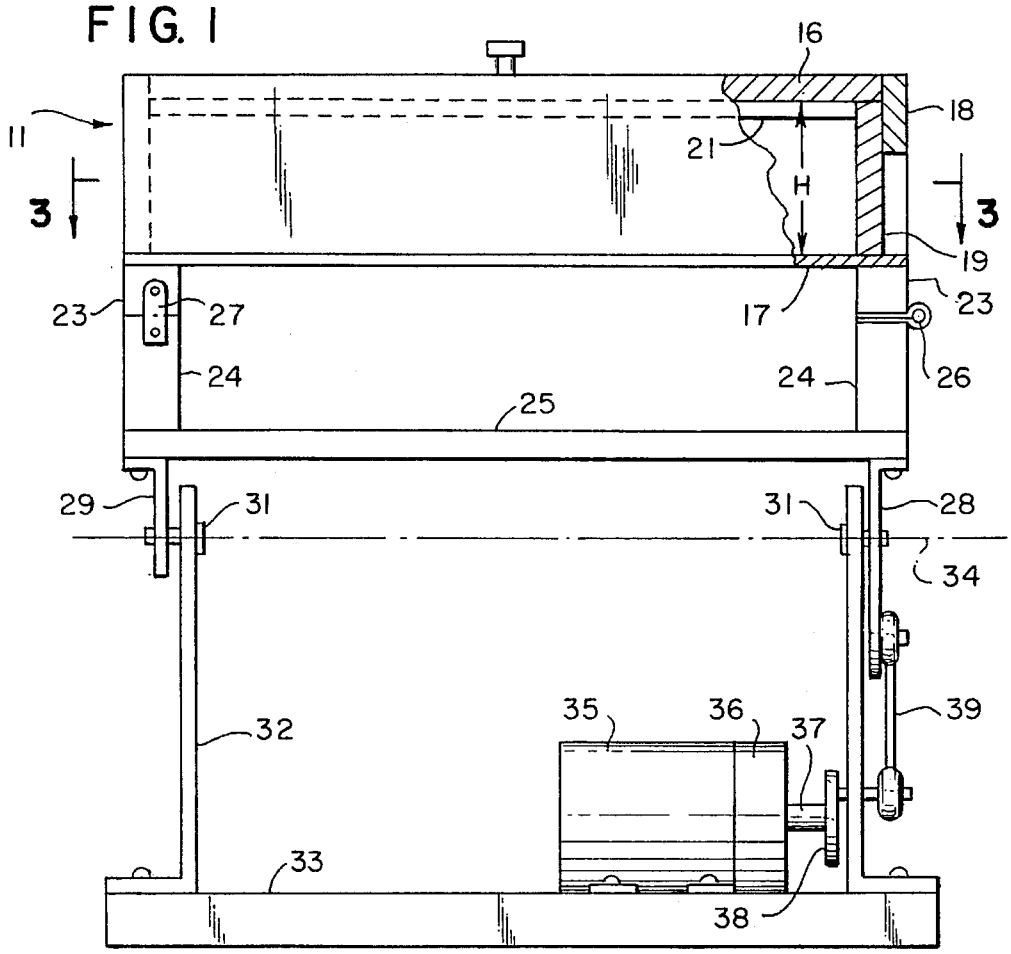
FIG. 1 is a front elevational view, partly in section, of a portable tip-agitating apparatus.
Figure 3:
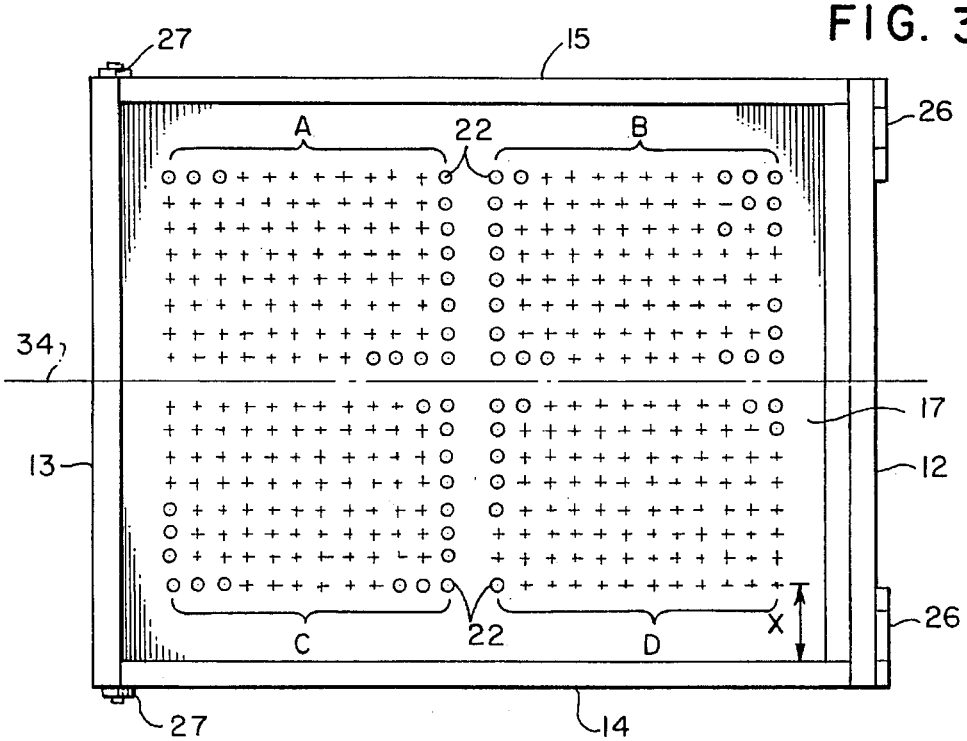
FIG. 3 is a sectional view taken on line 3—3 of FIG. 1.

The portable agitating apparatus shown in FIGS. 1–3 comprises a rectangular container 11 having walls defining two pairs of opposing sides 12, 13 and 14, 15, a removable lid 16 constituting a top which may be opened, and a floor 17. Side 12 also may be opened, so it is defined by a fixed Wall member 18 and a vertically sliding wall member 19. Lid 16 rests upon the top of member 19 and upon a ledge 21 running around the other three container sides. Floor 17 contains at least one field of openings 22 having a pattern corresponding to the pattern of the array of apertures of the tip holder to be loaded. As illustrated, four such fields A–D are provided, each having the 8×12 matrix of ninety six openings 22 characterizing commonly used tip holders. Since the diameter of openings 22 depends upon the size of the tips to be loaded, and not all holders utilize the same pattern (e.g., some employ staggered arrangements of apertures), it is recommended that floor 17 be made removable. In this way, the apparatus can satisfy the needs of a variety of holders simply by replacing floor 17 with an alternative having the appropriate field or fields.

At each of its four corners, container 11 has a foot 23 aligned with a pedestal 24 carried by support plate 25. The vertical spacing between plate 25 and floor 17 is sufficient to insure that tips lodged in openings 22 and depending from floor 17 will not touch plate 25. The feet 23 and pedestals 24 located beneath container side 12 are connected by hinges 26 so that the container may be tilted about an axis parallel with and closely adjacent side 12. The set of feet 23 and pedestals 24 at the opposite side of container 11 are releasably joined by a pair of spring latches 27.

Support plate 25 is equipped with a pair of depending, L-shaped brackets 28 and 29 having vertical legs journaled on pivot pins 31 carried by a pair of columns 32 attached to base plate 33. Pins 31 define a tilt axis 34 for container 11 which is parallel with floor 17 and centered between sides 14 and 15. Rocking motion of the container about this axis is effected by an electric motor 35 equipped with a speed-reducing transmission 36 and having an output shaft 37 coupled with the vertical leg of bracket 28 through a disc-shaped crank 38 and a connecting rod assembly 39.

It is desirable that the container portion of the apparatus (i.e., parts 11–27) be easily detachable from the remainder, so that the former may be autoclaved, sterilized by u.v. radiation, cleaned, scrubbed or disinfected. Therefore, the components of the container portion should be made of materials known to withstand such treatments.

Several detailed features of container 11 merit attention here. First, as indicated in FIG. 3, the four fields A–D are arranged in pairs symmetrically with respect to axis 34, and the long rows, rather than the shorter columns, of openings 22 are parallel with that axis. In addition, the margins of fields A–D are spaced from the container sides, with the spacing X between each of the sides parallel with axis 34 (i.e., sides 14 and 15) and the fields being the larger of the two. Preferably, this spacing is at least 2", thereby forming fairly large tip-accumulation zones during agitation. These measures speed up the process of filling openings 22 with pipette tips.

Second, it has been found that the rate at which tips are captured by openings 22, and consequently the efficiency of the apparatus, is adversely affected by the thickness of floor 17. Therefore, the floor should be as thin as practical. A thickness on the order of 0.015" is recommended.

Figure 4:
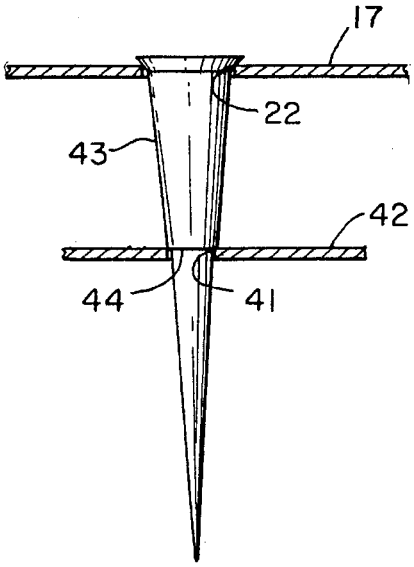
FIG. 4 is an exaggerated diagram illustrating the ways in which a tip seats in the aperture of a holder and in a field opening of the agitating apparatus, respectively.

Another important detail is depicted in FIG. 4. Whereas the apertures 41 of a holder plate 42 are sized so that the plate catches the tapered tips 43 at their shoulders 44, the openings 22 in floor 17 are larger and effect tip capture near, and preferably adjacent, the large diameter ends of the tips. It is important to minimize the upward projection of lodged tips from floor 17, because this reduces the risk that those tips will be dislodged during agitation, and that they will impede tip capture by adjacent openings. As a result, complete, rapid filling of all openings 22 with tips is encouraged.

Finally, it should be noted that the height H of the confined space within container 11 (see FIG. 1) must be correlated with tip length. If the height is significantly less than tip length, tips obviously will not lodge in openings 22. On the other hand, if the height is substantially greater than tip length, many "doubles" (i.e., tips nested in tips already lodged in openings 22) will be created. Experience indicates that a height slightly less than one tip length is satisfactory, yielding only occasional "doubles".

The complete tip-loading apparatus of the invention also includes the straightening/transfer device 45 shown in FIG. 5. This device comprises a base plate 46 from which project a group of straight fingers 47 arranged in the same pattern as the fields A–D of container 11. It is desirable that fingers 47 be tapered, as this facilitates their insertion into the tips lodged in openings 22, but it is vital that they not frictionally bind with the interior surfaces of the tips. An acceptable design employs as fingers 47 the very pipette tips with which device 45 is intended to be used, these finger-serving tips simply being pressed or glued in place in bores extending through base plate 46. In a more refined version suitable for mass production, the fingers and base would be a one-piece molded plastic unit.

According to the invention, the process of loading tip holders begins by removing lid 16 and charging container 11 with numerous pipette tips. Charging can, and should, be accomplished simply by pouring tips from one of the plastic bags in which they are supplied, as this obviates handling of the tips by the technician, and thus minimizes the risk of contamination. The exact number of tips put in the container is not significant, yet it must be considerably larger than the total number of openings 22 to be filled, but not so large as to preclude jostling of the tips in the container. In the case of one version of the illustrated embodiment, wherein container 11 was approximately 12"×13"×1", and floor 17 contained four fields A–D affording three hundred eighty four openings 22, satisfactory performance was achieved using a whole bag containing the usual one thousand tips.

After charging, lid 16 is installed, and motor 35 is energized to rock container 11 about axis 34. The oscillating motion of the container must be adequate to agitate the tips, causing them to tumble about within the container and lodge in openings 22 with their pointed ends depending from floor 17. No precise intensity of agitation in needed, although obviously it is desirable that the openings 22 be filled with tips in a reasonably short time period. For the example described herein, a rocking frequency of 180 oscillations per minute with an angular amplitude of 30° achieved the desired filling result in 3–4 minutes. Progress of the filling step can be checked periodically by stopping motor 35 and removing lid 16, or, if lid 16 is transparent, simply by observation.

When the openings 22 of fields A–D are full of lodged tips, motor 35 is stopped, lid 16 and wall member 19 are removed, and latches 27 are released. Container 11 now is tilted about the axis of hinges 26 to cause excess tips (i.e., those not lodged in openings 22) to fall, tumble or roll down floor 17 by gravity and exit through the open side 12. To avoid contamination, the tips should not be touched, but allowed to move freely from container 11 into a suitable collection receptacle, such as one of the plastic supply bags. If any of the loose tips hang up on the protruding upper ends of the lodged tips in openings 22, they may be freed easily without touching by swinging the container back and forth about the axis of hinges 26, or by using a sterile prong.

After clearing excess tips from fields A–D, the technician returns container 11 to the normal position shown in the drawings, then lowers a straightener device 45 into each field of lodged tips and holds these devices in place using lid 16. Now, the combination comprising container 11, the lodged tips, the four devices 45 and lid 16 is inverted by pivoting it 180° about the axis of hinges 26, to thereby allow the lodged tips to be withdrawn freely from openings 22 by lowering lid 16 and the straightening devices 45 which rest on it. Container 11, but without lid 16, is now swung back to its initial position, and a tip holder is lowered onto and mated with each field of tips carried by a device 45. Finally, each assembly comprising a device 45, a field of impaled tips 43 and a holder is inverted, and the devices 45 are lifted to withdraw fingers 47 from the tips, leaving four fully loaded tip holders.

Certain aspects of the invention require further elaboration, lest the detailed description give a misleading impression of the broader features of the invention. With regard to the agitating step, the important consideration is that the tips be subjected to random motion which causes them to lodge in openings 22, not the nature of the mechanism which causes that motion. A variety of periodic motion generators, including vibrators or shakers, are considered suitable alternatives to the rocking mechanism employed in the illustrated embodiment. One specific alternative I found acceptable is the RED ROTOR PR70 orbital shaker marketed by Hoefer Scientific Instruments. In this case, the support plate 25 of the container portion 11-27 of the illustrated apparatus was placed on and coupled to the shaker platform, and the machine was operated at a speed in the range of 350–400 RPM. At this frequency, the 25 mm circular orbit provided by the shaker gave tip-filling performance comparable to that afforded by the illustrated rocking mechanism. Another specific embodiment used the model USBDbo BELLY DANCER shaker marketed by Stovall Life Sciences Inc. While this version of the invention worked well, its top speed of 100 RPM made tip filling take somewhat longer than in the case of the other versions.

Since the shakers, such as those mentioned above, are reliable, have UL approval, and are already at hand in most biomedical laboratories, the container portion 11-27 per se of the disclosed apparatus could well be an attractive product when marketed with a universal adapter which allows plate 25 to be coupled to the platform of any of the various suitable shakers users may possess.

The invention also encompasses alternatives for the tip-transfer step, the key feature of which is that the tips lodged in openings 22 be shifted as a group from container 11 to the tip holders. One possibility is to employ openings 22 having margins which retain the tips during agitation, but yield to allow the tips to be pushed through floor 17 by the straightening devices 45. This scheme affords direct transfer of the tips to holders positioned beneath floor 17, eliminating the inverting manipulations characteristic of the illustrated embodiment. Another possibility is to form the openings 22 of fields A–D in plates which are releasably connected to a permanent floor portion of container 11, and which may be withdrawn from the container in the upward direction along with the lodged tips and the mated straightening devices 45. While this alternative also eliminates inverting manipulations, that advantage may be offset by the fact that the removable plates are transferred to the tip holders along with the pipette tips. Such an extraneous part, overlying the holder, could be jostled as a tip is picked up by a pipette barrel and cause unintended dislodgement of other tips in the holder.

Figure 6:
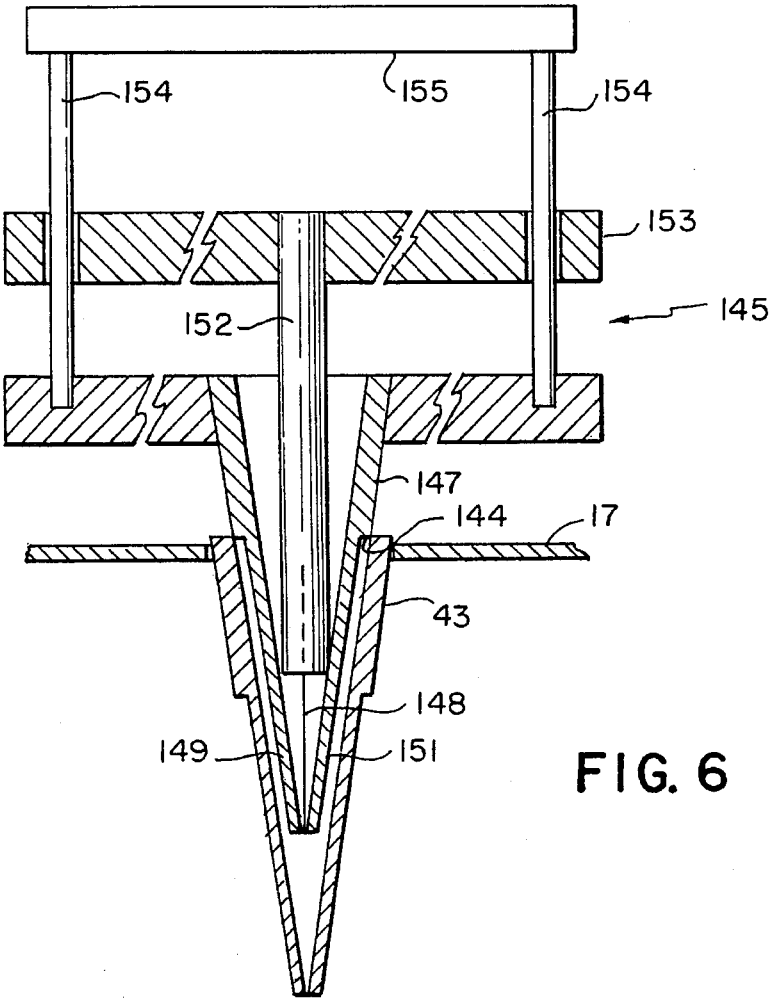
FIG. 6 is an enlarged sectional view of a portion of an alternative tip-straightening and transfer device.

The alternative straightening-transfer device 145 depicted in FIG. 6 also effects tip transfer without inversions. As in the case of its counterpart 45 of FIG. 5, device 145 employs a plate 146 carrying a field of hollow fingers 147, which may be pipette tips, but here each of these fingers is provided with a longitudinal split 148 which creates two flexible fingers portions 149 and 151. In addition, device 145 includes means for selectively expanding fingers 147. This means takes the form of a field of slender, circular rods 152, one for each finger, carried by a plate 153 mounted to slide freely in the vertical direction on a pair of guide rods 154 fixed in plate 146 and positioned at each end of that plate. Preferably, the upper end of each pair of rods 154 are interconnected by a handle 155.

When plate 153 and the attached rods 152 have been retracted upward sufficiently with respect to plate 146 to allow finger portions 149 and 151 to relax and assume their normal positions, device 145 may be lowered onto a field of tips lodged in floor 17, with each finger 147 entering a corresponding tip 43, and the shoulders 144 coming to rest on the upper ends of the tips. Then, the technician grasps the margins of plates 146 and 153 and squeezes them together. This action causes rods 152 to engage finger portions 149 and 151 and flex them outward into contact with the interior surfaces of tips 43, thereby frictionally locking the tips to the transfer device. Therefore, the tips may now be withdrawn as a group from floor 17 simply by lifting device 145. The whole group of tips then are deposited in the array of apertures of a tip holder. When the tips are in place, with shoulders 44 resting on the margins of the apertures, the technician squeezes plate 153 and handle 155 together using his fingers and thumbs, respectively, thereby retracting rods 152 from fingers 147 and allowing finger portions 149 and 151 to return to their relaxed positions. As a result, the fingers 147 may be withdrawn freely from the tips 43 in the holders by lifting device 145.

Finally, it will be observed that, since the specific version of the invention described herein is intended for laboratory use, the charging, clearing and transfer steps all are performed manually, as this keeps hardware costs to a minimum. The invention, however, encompasses more sophisticated embodiments, wherein all or more of the various steps are automated and which, therefore, yield the greater efficiency high volume suppliers may consider desirable or necessary.

I claim:

1. A method of loading disposable, plastic pipette tips into an array of apertures of a tip holder comprising a. agitating a multitude of tips more numerous than the apertures in said array in a confined space bounded by top and side walls and located above a floor containing at least one field of discrete openings, each for receiving a single tip, having a pattern corresponding to said array to cause tips to lodge in the openings, the lodged tips being gripped by the margins of the openings and hanging therefrom;

b. removing from the region of the field excess tips not lodged in the openings; and c. transferring said lodged tips as a group from the field to the array, d. the height of said confined space being correlated with tip length so as to minimize the risk that tips will nest in other tips already lodged in openings.

2. The method of claim 1 wherein said height is not greater than the length of the tips.

3. The method of claim 1 wherein the transferring step includes simultaneously inserting into the tips lodged in the openings a group of straight aligning fingers having a pattern corresponding to the pattern of said array.

4. The method of claim 1 in which said excess tips are removed by tilting the floor, whereby these tips are moved by gravity from the field of openings.

5. The method of claim 1 wherein the floor contains several fields of openings, each having a pattern corresponding to the pattern of said array; and the agitated tips are more numerous than the sum of the openings in the several fields.

6. The method of claim 1 in which each tip is tapered and has a shoulder intermediate its ends sized to rest on the margin of an aperture in the holder; and wherein each opening in said field is sized to fit a portion of a tip located between the shoulder and the larger end of the tip.

7. The method of claim 6 wherein each opening is sized to fit a tip portion immediately adjacent the larger end of the tip.

8. Apparatus facilitating loading of disposable, tapered, plastic pipette tips into an array of apertures of a tip holder comprising a. a closed container having walls defining sides, a lid which may be opened, and a floor containing at least one field of discrete openings, each for receiving a single tip, having a pattern corresponding to the pattern of said array, the openings being so sized that their margins grip the tips near their larger diameter ends; and b. powered means connected with the container for subjecting it to periodic motion which causes tips placed therein to be agitated and become lodged in the openings, c. the vertical distance between the floor and the lid being correlated with tip length so as to minimize the risk that tips will nest in other tips already lodged in openings.

9. The apparatus of claim 8 in which one of said sides may be opened; and the container is connected by hinge means to a support so it may be tilted about an axis parallel with and adjacent said one side.

10. The apparatus of claim 8 in which the floor contains several fields of openings, each of which has a pattern corresponding to the pattern of said array.

11. The apparatus of claim 8 wherein each opening in said field is larger than each aperture, whereby the margins of the openings grip tapered tips closer to their larger ends than the margins of the apertures.

12. The apparatus of claim 8 wherein said powered means comprises means supporting the container for rocking movement about an axis parallel with the floor and located intermediate opposed sides of the container; and motor means connected with the container for oscillating same about said axis.

13. The apparatus of claim 12 including a base carrying both the container supporting means and the motor means, the parts forming a self-contained, portable unit.

14. The apparatus of claim 12 wherein the container is rectangular in plan, having a first pair of opposed sides at opposite sides of said axis; and the field of openings is spaced from each of said first pair of sides to provide intervening tip-accumulation zones.

15. The apparatus of claim 8 in which said vertical distance is slightly less than the length of a tip.

16. The apparatus of claim 12 in which the floor contains four rectangular fields arranged in pairs symmetrically at opposite sides of said axis; and the container is rectangular in plan, having a first pair of opposed sides at opposite sides of said axis and spaced from the margins of the fields to provide intervening tip-accumulation zones.

17. The apparatus of claim 16 in which the container has a second pair of opposed sides, one of which may be opened; and the container is connected with a support member by hinge means having a pivot axis parallel with and adjacent said one side which may be opened.

18. The apparatus of claim 8 including a straightening and transfer device for transferring as a group tips lodged in said openings to the array of apertures of said tip holder comprising a. a base plate; and b. a field of straight fingers projecting from the base plate, the fingers being sized to fit into the tips, and the field having a pattern corresponding to the pattern of said array.

19. The device of claim 18 in which each finger is hollow and is split longitudinally to define two flexible portions; and which includes means for selectively expanding the flexible portions.

20. The device of claim 19 in which the expanding means comprises a support plate; means interconnecting the support and base plates for free movement toward and away from each other; and a plurality of rods projecting from the support plate and arranged so that one rod enters each finger, the rods serving to deflect said flexible portions outward when the plates are pressed together and allowing said flexible portions to relax when the plates are moved apart.

* * * * *